US008960855B2

(12) United States Patent
Hudd et al.

(10) Patent No.: US 8,960,855 B2
(45) Date of Patent: Feb. 24, 2015

(54) PRINT HEAD MODULE

(75) Inventors: Alan Hudd, Bourn (GB); Gerrit Koele, Diepenheim (NL); James E. Fox, Royston (GB); Paul Wallace, Royston (GB)

(73) Assignee: Ten Cate Advanced Textiles B.V., Nijverdal (NL)

( * ) Notice: Subject to any disclaimer, the term of this patent is extended or adjusted under 35 U.S.C. 154(b) by 75 days.

(21) Appl. No.: 13/821,274

(22) PCT Filed: Sep. 8, 2011

(86) PCT No.: PCT/EP2011/065571

§ 371 (c)(1), (2), (4) Date: Oct. 21, 2013

(87) PCT Pub. No.: WO2012/032127

PCT Pub. Date: Mar. 15, 2012

(65) Prior Publication Data

US 2014/0028748 A1 Jan. 30, 2014

Related U.S. Application Data

(60) Provisional application No. 61/442,358, filed on Feb. 14, 2011.

(30) Foreign Application Priority Data

Sep. 8, 2010 (GB) ..... 1014952.4

(51) Int. Cl.

| | |
|---|---|
| ***B41J 2/15*** | (2006.01) |
| ***B41J 19/16*** | (2006.01) |
| ***B41J 2/21*** | (2006.01) |
| ***B41J 3/407*** | (2006.01) |
| ***B41J 11/00*** | (2006.01) |

(Continued)

(52) U.S. Cl.

CPC .. *B41J 19/16* (2013.01); *B41J 2/15* (2013.01); *B41J 2/2132* (2013.01); *B41J 3/4078* (2013.01); *B41J 11/0015* (2013.01); *D06P 5/30* (2013.01); *B41J 2/115* (2013.01); *B41J 2/16* (2013.01);

(Continued)

(58) Field of Classification Search

CPC ..... B41J 19/16

See application file for complete search history.

(56) References Cited

U.S. PATENT DOCUMENTS 4,907,013 A 3/1990 Hubbard et al.
4,963,882 A 10/1990 Hickman (Continued)

FOREIGN PATENT DOCUMENTS

EP 0829368 A2 3/1998
EP 1112845 A1 7/2001

(Continued)

OTHER PUBLICATIONS

International Preliminary Report on Patentability issued on Dec. 14, 2012.

*Primary Examiner* — Julian Huffman

(74) *Attorney, Agent, or Firm* — Hoyng Monegier LLP; Minerva Rivero; David P. Owen

(57) ABSTRACT

A print head module (20) for depositing a substance has an axis and a plurality of print heads (22) provided with nozzles (23). The heads are distributed along the axis to form an elongate compound head having nozzle redundancy by arranging the heads in partially overlapping relation to one another. This allows deposition of the substance from the nozzles in uniform swathes having different angles transverse to the axis.

31 Claims, 8 Drawing Sheets

(51) Int. Cl.
*D06P 5/30* (2006.01)
*B41J 2/115* (2006.01)
*B41J 2/16* (2006.01)

(52) U.S. Cl.
CPC ..... *B41J 2202/19* (2013.01); *B41J 2202/20* (2013.01)
USPC ..... 347/40

(56) References Cited

U.S. PATENT DOCUMENTS

| | | | |
|---|---|---|---|
| 5,455,610 | A | 10/1995 | Harrington |
| 5,581,284 | A | 12/1996 | Hermanson |
| 5,587,730 | A | 12/1996 | Karz |
| 5,640,183 | A | 6/1997 | Hackleman |
| 6,106,102 | A | 8/2000 | Richtsmeier et al. |
| 6,439,786 | B1 | 8/2002 | Hasiuk |
| 2003/0103100 | A1 | 6/2003 | Vanhooydonck et al. |
| 2004/0021730 | A1 | 2/2004 | Yamane |
| 2006/0274099 | A1 | 12/2006 | Jahana et al. |
| 2010/0182382 | A1 | 7/2010 | Lee et al. |

FOREIGN PATENT DOCUMENTS

| | | | |
|---|---|---|---|
| EP | 1573109 | B1 | 9/2003 |
| JP | 10315541 | A | 12/1998 |
| WO | 2004072360 | A2 | 8/2004 |
| WO | 2009056641 | A2 | 5/2009 |

PRINT HEAD MODULE

CROSS REFERENCE TO RELATED APPLICATIONS

This application is a 35 USC §371 national phase application of PCT application number PCT/EP2011/65571 filed on 8 Sep. 2011, which claims priority from GB application number 1014952.4 filed on 9 Aug. 2010, as well as from U.S. provisional application 61/442,358 filed on 14 Feb. 2011. All applications are hereby incorporated by reference in their entireties.

BACKGROUND OF THE INVENTION

1. Field of the Invention

The invention relates generally to a print head module for the deposition of a substance onto a substrate using printing techniques and the like. The invention further relates to a device for producing such a print head module and to procedures for performing deposition in a continuous process, in particular in the fields of textile printing and finishing.

2. Description of the Related Art

Systems for inkjet printing of images and text onto a substrate are generally known. Many such systems are adapted to desktop or office application and are well suited for performing printing onto A3 or A4 sized paper or the like. For wider substrates, more specialized machinery is required, in particular when high speed and high throughput are important. For such applications, inkjet printing techniques may be used as well as lithographic and conventional printing techniques.

For textiles, inkjet printing techniques have also recently been developed as an alternative to traditional printing, dyeing and coating techniques. These techniques are generally distinct from those used in the graphics field, due to material and dyestuff considerations. Attempts have also been made to adapt inkjet deposition techniques for textile upgrading and finishing procedures. A characteristic of these processes is often that they require considerable volumes of product to be deposited across the whole textile surface. In many situations, the uniformity of the deposition or coating is of paramount importance as the quality of the fabric depends upon it. This uniformity may be important from a visual perspective (absence of streaks or blemishes) and also from a functional perspective (waterproofing or flame retardancy).

There are currently two main system configurations used for inkjet printing: fixed array systems and scan and step arrangements. Both are mainly used with drop on demand (DoD) techniques but may also be used with continuous inkjet (CU) techniques.

Fixed array systems allow printing of a continuously moving substrate at relatively high production speeds. A fixed array of print heads is arranged across the width of the substrate and the nozzles are activated to deposit material as required onto the substrate which is in continuous motion below the print head array. Typically fixed array systems are used for narrow width substrates on continuous reel to reel web systems, as only a few print heads are required to cover the width of the substrate. The use of fixed array inkjet procedures for textile finishing is described in European Patent EP-B-1573109.

Fixed array systems have a number of drawbacks, mainly related to the low flexibility and lack of redundancy in such a printing system. When printing onto a wide substrate with a fixed array system, a large number of print heads are required to straddle the width of the substrate, leading to a high capital cost for the printing system. If the required substrate speed is below the maximum speed of the print head (e.g. due to other slower processes), then this extra system capacity cannot be usefully exploited and is wasted i.e. at anything below maximum speed, the printing system is making inefficient use of the print heads present. The resolution across the substrate width is fixed by the position of the print head nozzles and cannot therefore be readily varied. When maintenance of a print head is required, the substrate must stop and the array must be moved away from the substrate to allow access to the print heads. This is often a relatively complex operation and the downtime associated therewith can be costly. In the event that a nozzle fails during printing, a single vertical line appears on the substrate, which is a particularly visible mode of failure and represents a complete 100% failure to deposit material in the localized area. Printing a continuous image also requires a complex continuous data handling system. The system must continuously feed data to the print head nozzles, to maintain the image continuously printing on the substrate and there is no obvious break point (or time) where memory can be reloaded. This means that many fixed array printing systems have a repeat length dependant on their memory capacity, after which the image is simply repeated. This situation can be avoided by using dynamic memory handling where data is fed into memory as fast as it is fed out to the print heads but this requires a significantly more complicated memory management system.

Scan and step arrangements operate to scan a print head carriage across the width of a stationary substrate to print a horizontal band or swathe. The substrate is then precisely incremented forwards, before the print head carriage makes another pass across the stationary substrate to print a second swathe. Such systems are typically used for printing onto wide substrates of up to 5 m where a fixed array would be impractical. They are also used in applications where lower productivity is acceptable i.e. wide format commercial graphic arts printing.

For printing onto wide substrates, relatively elongate print head modules or carriages are known which may print a wide swathe during each scan. Conventional inkjet printing heads are limited in length and a print head module may be made up of a number of individual heads mounted together. It is however not generally possible to locate two heads next to one another without leaving a gap between. This is because, for presently available heads, the extent of the nozzles from which deposition occurs is less than the length of the actual head. In other words, the length of the active region of a print head, containing the nozzles, is less than the length of the actual print head due to the inactive regions around the edges of the print head and at the ends, where attachment elements may be located. Prior print head modules have solved this problem by offsetting and staggering heads in adjacent rows in what may be referred to as a comb formation. An incremental width is left between adjacent heads in a first row of heads. A second row of print heads is aligned to exactly cover the gaps between the heads in the first row.

In certain situations it has been suggested to allow a limited overlap of the print heads in each row of such an elongate print head module. In this manner, discrepancies due to the accuracy of the mounting of the heads may be compensated or stitching between the swathes may be more accurately controlled. US 2006/0274099 and US2004/0021730 provide modules having a limited degree of print head overlap for such purposes. In these arrangements, printing takes place in scan and step mode and further overlap would lead to inefficient use of the print heads.

Scan and step systems also have a number of drawbacks, mainly focused on the low productivity and the stepping nature of the substrate motion. In particular, the stepping of the substrate means that such a system has poor compatibility when used as a component or process within a continuous production line. The time taken to increment or step the substrate cannot be used for printing and limits productivity. The stepping motion also means that the substrate must be rapidly accelerated and decelerated, which requires powerful motors and a high level of control when dealing with wide substrates on heavy rollers. The stepping motion must also occur with high accuracy and repeatability, as this motion affects the down web resolution and thus the quantity of material deposited (for functional applications) or the image quality (for imaging applications). According to one device disclosed in EP-A-0829368, one or more print heads may be oriented to scan the width of a textile web at a bias angle. By printing diagonally, the print heads may operate for longer at their maximum traverse velocity. The loss of efficiency due to acceleration and deceleration of the print head is thereby reduced although operation still takes place in scan and step mode.

All of these drawbacks have hitherto made continuous, high-speed and highly uniform deposition onto wide substrates difficult to achieve. In particular, the reliability of print heads for such operations is still far from optimal. A DoD nozzle requires continuous preventative maintenance in order to keep it functioning correctly, which is a key element in system design. If the nozzle is not used for a period it will block and not fire when subsequently required. For scan and step systems, the scanning motion of the print heads allows the turn around time at the end of each pass to be available for regular maintenance of the print heads. This may involve the cleaning of each jet or nozzle to prevent blockage and/or spitting of ink from idle nozzles. Nevertheless, the maintenance time comes at the expense of intermittent motion of the substrate. This can be a cause of additional indexing faults and wear in the drive train. Furthermore, the rapid acceleration of the print cartridge at each traverse is a potential source of mechanical failure and a design limitation.

In an array configuration, regular maintenance opportunities are not available. There have been many attempts in the inkjet industry to compensate for missing nozzles or malfunctioning nozzles. U.S. Pat. No. 4,907,013 discloses circuitry for detecting a malfunctioning nozzle in an array of nozzles in the inkjet print head. If the printer processor is unable to compensate for the malfunctioning nozzle by stepping the print head and using non-malfunctioning nozzles during subsequent passes over the print medium, the printer is shut down. U.S. Pat. No. 4,963,882 discloses using multiple nozzles per pixel location. In one embodiment, two ink droplets of the same colour are deposited upon a single pixel location from two different nozzles during two passes of the print head. U.S. Pat. No. 5,581,284 discloses a method for identifying any failed nozzle in a full width array print bar of a multicolour printer and substituting at least one droplet from a nozzle in another print bar having a different colour of ink. U.S. Pat. No. 5,640,183 discloses a number of droplet ejecting nozzles that are added to the standard column of nozzles in a nozzle array, so that a number of redundant nozzles are added at the ends of each column of nozzles. The print head is shifted regularly or pseudo-randomly such that a different set of nozzles prints over the first printed swathe during a subsequent pass of the print head in a multi-pass printing system. U.S. Pat. No. 5,587,730 discloses a thermal inkjet printing apparatus having a redundant printing capability including a primary print head and a secondary print head. In one mode, if the primary print head fails, the secondary print head prints ink drops of the first colour in place of the primary print head.

A printing device is disclosed in U.S. Pat. No. 6,439,786 that attempts to synchronise motion of a web of paper with traverse of a print head in order to achieve continuous paper feed. The print head is mounted to traverse on a beam that can be angled in two directions with respect to the feed direction. On each traverse the print head moves with the paper to produce a resultant horizontal print band on the moving paper.

In a further device disclosed in Japanese Publication JP10-315541 a serial printer is described for enhancing print resolution in the paper transport direction. This is achieved by continuously transporting the paper whereby effects of backlash in the transport mechanism may be reduced. Printing onto the moving substrate results in diagonal swathes which may be aligned with each other in single or double pass movement. The device is directed to printing onto sheets of paper and is not concerned with enhancing printing speed on large format substrates. In particular, when printing on both the forward and reverse passes, the print head addresses only unprinted areas of the paper, leading to inefficient nozzle usage. Furthermore, the document fails to address the need for enhanced head length for printing wide swathes onto large format substrates. Print head modules having heads arranged in comb arrangement as mentioned above may work well in a scan and step mode but are not directly suitable for operation in a diagonal manner in two passes. This is because the offset and staggered rows of heads cannot align on both diagonal passes.

A recent development is described in PCT application WO2009/056641, the contents of which are hereby incorporated in their entirety, in which a substance is deposited onto a continuous supply of substrate by traversing a deposition arrangement across the substrate to deposit the substance in a number of swathes. The substrate may be carried by a transport arrangement in the form of a conveyor belt. By synchronising the transport and traverse motions, the swathes can be made to complement one another, thus achieving substantially complete coverage of the substrate. The principle combines advantages of both scan and step and fixed array systems to achieve reliable printing with continuous substrate motion.

According to one embodiment of the device disclosed in WO2009/056641, two complementary swathes of the substance are deposited by two carriages, each mounted for independent motion on a respective beam. Each carriage comprises a plurality of heads, thus achieving a wide swathe in the transport direction and more efficient coverage. While this arrangement has been found to operate in a satisfactory manner, the setting up thereof is difficult and variations in transport speed or other print parameters can require recalibration. Any motion of the substrate with respect to the transport belt between the first and second carriages can be catastrophic to the result. The same applies to irregularities in the motion of the transport belt. These and other difficulties become more significant as the substrate width and transport speed increase. A need therefore exists for an arrangement that can operate from a single beam and that occupies relatively little overall length in the transport direction in order to minimise transport inaccuracies resulting from shifting of the substrate or the like. There is also a need for a reliable deposition head arrangement that can be implemented using conventional print heads that are relatively short compared to the width of substrate to be treated. In order to be able to print a broad and uniform swathe at different swathe angles in diagonal mode onto a broad substrate, it is nevertheless desirable to have a deposition head arrangement that is compact, while having a significant active length with respect to the substrate width.

There also exists a need for an arrangement allowing accurate disposition of multiple print heads within a print head module in order to produce a compound head.

BRIEF SUMMARY OF THE INVENTION

The present invention seeks to address at least some of these difficulties by providing a print head module for depositing a substance onto a substrate, the print head module having a transport axis and a traverse axis and comprising first and second print heads having nozzles for depositing the substance, the first and second print heads being staggered with respect to one another along the transport axis and offset from one another along the traverse axis to form an elongate compound head having a length greater than a length of either the first or the second print head, whereby the first and second print heads overlap one another along the transport axis, providing nozzle redundancy and allowing deposition onto the substrate at different swathe angles with respect to the traverse axis, of contiguous first and second swathes of the substance, from the nozzles of the respective first and second print heads. By providing a relatively broad compound swathe from a single carriage that is uniform in both forward and reverse diagonal passes, diagonal printing can take place efficiently even across wide textiles. No alignment and synchronisation between a pair of carriages is required. This can reduce significantly the calibration required at set-up and can eliminate possible variations in deposition along the substrate transport direction. Preferably, the resulting compound head will have an operational length in the transport direction of at least 0.2 m, preferably at least 0.3 m and even as much as 0.8 m. Each of the individual print heads may have an active length significantly shorter than this. The compound head as described above may be relatively compact compared to existing designs and for the same number of nozzles can occupy less than half the length in the transport direction compared with a comb arrangement operating over two beams as described in WO2009/056641.

In a preferred embodiment the print heads are arranged in at least first and second parallel rows with their nozzles aligned substantially parallel to the transport axis. In this manner, individual heads may be separately mounted in staggered relationship covering substantially the full length of the print head module without the mounting region of each head interfering with that of an adjacent head. The rows may be horizontally offset from one another by the width of the head, this generally being from 0.5 cm to 4 cm, more preferably between 2 cm and 3 cm. In this context "horizontal" is intended to refer to the traverse or Y axis and direction and this convention will be adhered to throughout the present description. Similarly, "vertical" will be used to refer to the transport or X axis and direction. The actual offset will usually be dictated by the physical dimensions of the heads being used although other factors may also be relevant, in particular, the firing sequence of the nozzles between different heads in order to produce a coherent pattern on the substrate. The skilled person will understand that the horizontal offset between heads will at least partially determine the degree of nozzle redundancy required for a given swathe angle. Equally, although two rows are preferred, further rows of heads for deposition of the same substance may be provided e.g. if greater coverage is required.

The heads in each row may be arranged in comb formation with a gap between adjacent heads being slightly smaller than the length of a head. In the following, reference to the length of a head is intended to refer to the operational length, namely the length over which it can print. The spacing between adjacent heads in a row may be such that the rows overlap with a nozzle redundancy of more than 2.5%, preferably more than 5%, most preferably more than 8% but preferably less than 50%. For a given head configuration, the nozzle overlap determines the maximum swathe angle that may be printed. In this context, nozzle redundancy is intended to refer to the number of nozzles that overlap with the nozzles in an active region of a neighbouring head along the transport axis as a percentage of the total number of nozzles on that head.

Preferably, the print head module is arranged such that the heads overlap sufficiently to permit printing of uniform swathes over swathe angles of at least from +3° to −3° with respect to the traverse axis. Preferably, sufficient overlap is present for printing of at least from +5° to −5°, more preferably from +10° to −10° As discussed above, the ability to print a uniform compound diagonal swathe on both passes depends both on the configuration and redundancy of the heads and nozzles. For two rows of heads, the overlap between the heads in each row and the distance between the rows will determine the maximum swathe angle. In this context, uniform is understood to refer to the fact that the print head module is capable of uniformly addressing every point within the compound swathe without leaving gaps or creating overlap regions that have received more of the substance than other regions. It will of course be understood that this is independent of any intended design or pattern being deposited.

Most preferably, the print head module comprises a plurality of heads wherein the heads overlap one another by at least 12 nozzles, preferably at least 24 nozzles and most preferably around 45 nozzles or more. Certain prior art compound head modules exist where a limited amount of overlap exists between heads in order to allow stitching of the swathe edges. Such stitching may require an overlap of e.g. 1-5 nozzles but will usually require operation of all of the nozzles during a printing traverse in order to produce a uniform compound swathe aligned with the traverse direction. In certain prior art cases, not all of these overlap nozzles are capable of normal printing. Some may be "blanks" for alignment purposes or reduced volume nozzles for stitching purposes. According to the invention, the nozzles of the first and second print heads may be substantially similar, as are also the overlapping nozzles. The length of the nozzle overlap region may be at least 1 mm, preferably at least, 3 mm and even as much as 5 mm.

In one embodiment of the invention, the print head module comprises four heads in two offset rows. The total length of the compound head will then be four times the length of each individual head, decreased by the amount of overlap. This has the effect of creating one long active length of the compound head which is greater than the length of the individual print heads. In further embodiments, additional heads may be provided. It is observed that the invention is not limited to even numbers of heads since a first row may have three heads while a second row may have only two heads in order to overlap with the gaps between the heads in the first row.

The heads are most preferably inkjet heads. In the present context, the term inkjet head is understood to define any device that can bring a plurality of small droplets or jets of fluid to individually defined precise locations on a substrate. The term is intended to encompass DoD, piezo-electric, thermal, bubble jet, valve jet, CIJ, electrostatic heads and MEMS systems. The system according to the invention is independent of the specific heads used, whether they be supplied by e.g. Xaar™, Fuji Film™, Dimatix™ Hewlett-Packard™, Canon™, Epson™ or Videojet™. Most preferably the inkjet heads are of the drop on demand (DoD) type. Such heads are presently most preferred for their reliability and relatively low cost. In general, all of the heads within a module will be of the same type, although it is understood that this may not be essential since a distinct e.g. shorter head could be used for providing the redundancy. Furthermore, although the invention is not limited to any particular resolution, it is preferred that each head is capable of printing at at least 90 dpi, preferably at least at 180 dpi and more preferably at 360 dpi or above. It will be understood that since each head passes twice over the substrate, the final resolution will be double the dpi at which the head operates.

One print head available from Kyocera Corp. is arranged with four overlapping trapezoid regions in which the nozzles are located. When printing in normal mode, the overlapping regions ensure full area coverage. It has surprisingly been found that this print head is also able to operate in continuous mode with diagonal swathes at relatively low swathe angles. In that case, there is a minute area which is not covered on each swathe forming a line artifact. For operation at a swathe angle of 3.4 degrees, this equates to approximately 21% of a single nozzle area and cannot normally be perceived by the eye. Furthermore, the artifact is at least partially covered over on the return pass, thus leaving only 10.5% of a single nozzle area exposed. Dithering algorithms can be applied by the printing software, allowing deposition of larger drop volumes at the edges of the artifact to further obscure the defect at swathe angles of as much as 10 degrees. It will be understood that this effect can be appreciated both when printing using a single head and also when using a plurality of heads in a head module according to the invention. It will also be understood that although the invention is intended to apply to head modules having heads that are physically separable, the invention may also be applied to the construction of a single head comprising groups of nozzles that overlap in the manner as described above. The nozzles may then be controlled to fire as required to produce a single substantially uniform swathe at different swathe angles for both forward and reverse diagonal swathes.

Most preferably, the heads provide grey-scale droplet deposition which allows an additional degree of freedom of deposition when operating in diagonal mode. Previously it had been considered desirable to operate at defined swathe angles in order to allow individual droplet placement at defined matrix locations. This principle was believed to apply both to graphic printing and to textile finishing in order to ensure uniform coverage. It has however been found that by using software adaptation to control deposition volume and position, moiré effects and the like may be avoided irrespective of the swathe angle.

The print head module is preferably intended for deposition of a single substance and to this end, the first and second print heads may be connected to a single supply of the substance. This supply preferably comprises a single ink header tank per print head module, the ink header tank having multiple outlets which can supply the substance to the overlapping print heads. It is also possible to have more than one header tank supplying ink from one single bulk ink supply system to multiple bars of overlapping print heads. It will however be understood that each head may also have its own dedicated supply of that same substance. Preferably, a header tank is arranged in a recirculating configuration with the print heads whereby ink from the header tank can be circulated through the heads and back to the header tank. A bulk supply located on the fixed part of the printer may replenish the header tank.

In certain embodiments the module may comprise further pluralities of heads adapted to deposit further compound swathes of a different substance. These may be arranged as a plurality of rows of print heads, stacked in the horizontal direction with respect to one another. Each pair of rows may deposit a different substance: in the case of a CMYK head, eight rows of heads may be provided. It should thus be understood that, in general, there will be at least two rows of heads for each colour. Building up the print head module with multiple heads in this manner can increase its width in the traverse direction, requiring either a longer traverse or giving a narrower effective printing width.

The present invention also relates to a printer, comprising a substrate transport device for continuously transporting a supply of substrate in a transport direction and a print carriage comprising one or more print head modules as described above, having its transport axis generally aligned with the transport direction and arranged to traverse across the substrate for deposition of the substance in opposite diagonal swathes. The transport device is preferably adapted to operate at substrate speeds of at least 5 m/min, preferably 10 m/min and more preferably above 20 m/min with substrate widths of greater than 1 m, preferably greater than 1.4 m and most preferably greater than 1.6 m. It will of course be understood that the printer may operate at still greater speeds on narrower substrates.

According to the invention, the printer may comprise a controller arranged to deactivate a first group of nozzles during a first traverse and deactivate a second group of nozzles on a second traverse. It will be understood that for the sake of simplicity the controller may turn off a single group of nozzles during the whole of each traverse. Nevertheless, alternative firing arrangements may be considered in which all of the nozzles in the overlap region are used intermittently or randomly to provide a stitching effect and reduce the effect of failure of an individual nozzle.

The printer may be provided with a supply of the substance or substances to be deposited. In a preferred embodiment, each carriage comprises an ink header tank for each print head module which traverses across the substrate with the carriage. The ink header tank itself has multiple outlets which supply the same substance to the overlapping print heads of the module, thus enabling the supply of a single substance to a print head module having multiple overlapping heads. The ink supply is preferably also recirculated from the print heads back to the header tank. It will be understood that a non-traversing bulk ink supply may additionally or alternatively be provided. Additionally, the printer may further comprise a control arrangement for synchronising a traverse speed or position of the print carriage to a transport speed or position of the substrate to ensure substantially complete coverage of the substrate. This arrangement may make use of an encoder or other form of reading device, arranged to read the substrate and provide information to the control arrangement for guiding the deposition of the substance. The reading device may directly read a position or speed of movement of the substrate by following e.g. the weft of a textile. Alternatively, it may read indications printed or otherwise provided on the substrate or the transport device in the form of encoder markings or the like. It may also read the position based on prior deposited droplets. In this way, the carriage may be synchronised on its return pass or a subsequent forward pass or another carriage may be guided by e.g. the individual droplets or the edge of the swathe as deposited by a first carriage. Furthermore, although optical e.g. laser readers may be preferred, any other suitable reader allowing position feedback may also be employed, not limited to optical, tactile and mechanical devices. The control arrangement may synchronise operation such that the opposite diagonal swathes are complementary to one another and, at least at a macroscopic level, each region of the substrate is addressed by both diagonal swathes. At a microscopic or pixel level, this can be used to ensure that adjacent matrix locations in the pattern to be deposited are addressed on respective forward and reverse passes. It will of course be understood that the complementary swathes may also be chosen to address the same pixel location if desired. Alternatively, each pass may print half of the droplets in a given cell, defined as the smallest repeating pattern on the substrate. The resulting two-pass image has been found to be extremely fault tolerant.

According to a most preferred embodiment, the printer is adapted for use with a textile substrate and the transport device comprises an attachment arrangement to prevent shifting of the substrate during deposition. Such shifting may be very detrimental to accurate deposition, especially where a subsequent beam or carriage deposits another part of an image. Textiles are known to be sensitive to movement and distortion. Suitable attachment arrangements may comprise adhesive belts, vacuum, stenters and the like. It is however also within the scope of the present invention that the method may also be applied to individual items such as tiles, plates, sheets, clothing articles or the like, that are transported through the printing arrangement in a continuous manner. The printer preferably comprises a beam upon which the print carriage is mounted for traversing the substrate. Nevertheless, alternative arrangements may also be envisaged e.g. a traversing robot arm. In a preferred embodiment, the carriage may be mounted on a beam forming part of a linear motor for moving the print carriage. Such linear motor arrangements are ideal for ensuring improved accuracy of carriage positioning and may be constructed in a robust manner. They furthermore can have the advantages of smoother motion and lack of vibration when compared with other drive arrangements. Although the invention has been described in relation to a single carriage, additional carriages may be provided for certain reasons. In order to reduce the traverse distance (and hence the traverse time), a pair of print carriages may be provided whereby each print carriage traverses a respective half of the width of the substrate to deposit the substance. The print carriages may both traverse on the same beam and each may receive maintenance at a respective edge with stitching taking place at the midline. Alternatively or additionally, further carriages may be located upstream or downstream of the first carriage on the same or different beams, in order to provide further coverage of the same substance or deposit different substances e.g. where an image or functionality is built up in a number of stages.

Most preferably, at least one carriage is provided having a plurality of print head modules as described above. The print head modules may be located side by side in the horizontal traverse direction and each may be dedicated to deposition of a given substance. Thus a CMYK carriage would be provided with at least four modules.

The invention also relates to a method of depositing a substance onto a continuously moving substrate in forward and reverse transverse passes, the method comprising: providing a print head module comprising a plurality of print heads provided with nozzles; traversing the print head module across the substrate in a forward pass, during which a first plurality of nozzles is switched off to deposit the substance in a first uniform diagonal compound swathe; subsequently traversing the print head module across the substrate in a reverse pass, during which a second plurality of nozzles is switched off to deposit the substance in a second uniform diagonal compound swathe. By operating continuously according to the invention, substrate speeds of at least 5 m/min, preferably 10 m/min and more preferably above 20 m/min may be achieved with substrate widths of greater than 1 m, preferably greater than 1.4 m and most preferably greater than 1.6 m.

In this context, it is important to note that uniform coverage of the substrate is intended to refer to the ability of the print heads to address all areas of the substrate where deposition is intended. It is thus not necessary that actual deposition takes place at all positions. Printing of an image or pattern may require selective deposition, while application of a coating may require substantially complete coverage. It is also not a requirement that the totality of the substrate receives the uniform coverage. There may thus remain uncovered edge regions where deposition of the substance is not intended. Furthermore, although under most circumstances deposition will take place directly onto the final substrate, the present invention is also intended to cover indirect deposition e.g. onto a transfer reel or medium, which is subsequently applied to the substrate.

Preferably, each head extends in a transport direction of the substrate and overlaps with an adjacent head whereby at least certain nozzles are redundant for a given transverse pass. Alternative configurations may also be used to the extent that they achieve the same uniform coverage. Furthermore, although in general the heads will be separately mountable to the module, it is also envisaged that the method may be performed using a print head module in which the heads comprise individual regions of the module.

The method according to the invention preferably comprises performing maintenance on the heads between the forward and reverse passes. This may take place for all of the heads of the module or just for certain subgroups after each pass. The maintenance may take place while the module is stopped or during the movement of turnaround.

The method preferably comprises synchronising a traverse speed or position of the print head module to a transport speed or position of the substrate to produce diagonal swathes over swathe angles of at least from +3° to −3°, preferably at least from +5° to −5° and more preferably at least from +10° to −10° with respect to a traverse direction. The actual maximum swathe angle to be achieved will be determined by a number of factors including the overall length of the print head module, the substrate width and the head module configuration as discussed above.

The method also preferably comprises synchronising a traverse speed or position of the print head module to a transport speed or position of the substrate to ensure alignment of a forward pass of the first swathe with a subsequent forward pass. This may be achieved on the basis of e.g. software control and encoder feedback of the substrate position. Preferably, the print head module is carried by a carriage and is slaved to the substrate transport such that on reducing the transport speed the carriage speed also reduces accordingly. In this manner, the swathe angle remains constant for any substrate speed and the amount of calibration required is significantly reduced. Mechanical and hardware embodiments may also be used to achieve such synchronisation. In general, synchronisation with a subsequent forward pass will be such that the swathes overlap by 50% each time. In this manner, each portion of the substrate is addressed twice to ensure full coverage, namely once by the first compound swathe and once by the second compound swathe, as described in WO2009/056641. Nevertheless, the skilled person will also recognise that synchronisation can be without significant overlap such that each subsequent swathe abuts or is stitched with the previous swathe. In that case, more nozzles would be switched off during the traverse to avoid double printing in those areas where forward and reverse swathes cross one another.

In addition to controlling synchronisation and alignment at a macro or swathe level, the device may also be controlled to provide synchronisation and alignment at a micro or pixel level e.g. to ensure correct stitching between swathes. This may involve the use of conventional stitching software to reduce alignment perturbations between passes. It may also involve adjusting the volume of substance deposited by each drop e.g. using grey-scale type inkjet heads. This may be used in order to reduce moiré effects when droplets on different passes overlay one another. It may also be used to avoid colour variations where droplets of two different colours are overlaid in different order. Further preferred methods may involve the use of software including a dither function to provide accurate colour or shade reproduction e.g. by error diffusion or blending. In certain circumstances, the head modules may be operable at any swathe angle between horizontal and a given maximum. For other head configurations there may be certain angles that are favourable e.g. in order to place droplets in a given matrix configuration. In that case, the method may also comprise controlling the swathe angle and the operation of the nozzles to deposit individual droplets of the substance on the substrate at defined matrix locations. This deposition may be based on the spacing between adjacent nozzles of a head whereby the dpi definition in the horizontal direction is adapted to that in the vertical direction. This control may be particularly important for heads having nozzles offset from one another in the horizontal direction.

In a preferred embodiment of the method, the heads are arranged in the print head module in at least first and second parallel rows offset from one another in the horizontal traverse direction and with their nozzles substantially aligned with the vertical transport direction. The heads in each row may overlap one another with a nozzle redundancy such that during each traverse between 2.5% and 50%, preferably between 4.5% and 50%, more preferably between 8% and 50% of the nozzles are switched off to achieve the uniform compound swathes. Preferably, the heads overlap one another by more than 5 nozzles, preferably more than 10 nozzles and more preferably around 45 nozzles.

Most preferably, the print head module will comprise at least four heads depositing the same substance. The heads may comprise nozzles that can be individually controlled to deposit a drop on demand.

In one embodiment of the method, the substrate is a textile and the substance is an ink or dye and the method comprises uniform application of the ink or dye over substantially the whole surface of the textile. Achieving a deposition of a single colour at a uniformity equivalent to conventional dying procedures is extremely difficult. Any slight stitching inaccuracy or nozzle failure becomes most evident when viewed against a plain background. By using the method described above significantly better results have been achieved.

In a textile printing embodiment, the substrate is a textile and the substance is an ink or dye. In this case, the method comprises controlling application of the ink or dye to form a monochrome portion of an image on the textile. By providing further print head modules on the same or different carriages for depositing additional colours, a coloured image may be built up.

In a finishing embodiment of the invention the substrate is a textile and the heads are finishing heads. In this case, the method comprises applying a finishing composition to the textile. In this context, a finishing composition is understood as being a chemical that alters the physical and/or mechanical characteristics of the textile. Finishing techniques are meant to improve the properties and/or add properties to the final product. In this context, finishing may be distinguished as a species of printing by optionally defining it to exclude treatments involving deposition of materials that are applied to the substrate only because of their absorption properties at wavelengths between 400 nm and 700 nm or involving the recording of information. The finishing composition may be any finish appropriate for being deposited using the chosen deposition arrangement. In fact the choice of finishing head may be selected according to the nature of the finish required. In particular, the finishing composition may be selected from the group consisting of anti-static, anti-microbial, anti-viral, anti-fungal, medicinal, non-crease, flame-retardant, water-repellent, UV-protective, anti-odour, wear-resistant, stain-resistant, self-cleaning, adhesive, stiffening, softening, elasticity-enhancing, pigment-binding, conducting, semi-conducting, photo-sensitive, photo-voltaic, light-emitting, optical brightening, shrink resistant, handle imparting, filling & stiffening, weighting, softening, oil-repellent, soil repellent, soil release, felting, anti-felting, conditioning, lustring, delustring, non-slip, moisture vapour transport, anti-snagging, anti-microbiotic, reflecting, controlled release, indicating, phase changing, hydrophilic, hydrophobic, sensory, abrasion resistant and wetting agents.

The substrate is most preferably a textile. In the present context the term textile may be chosen to exclude paper, carton and other substrates that are two-dimensionally stable i.e. those that are flexible in a third dimension but are only marginally deformable within their own plane. In the same context, a textile may be understood to cover a flexible substrate formed from natural or artificial fibres or yarns by weaving, knitting, crocheting, knotting, pressing or otherwise joining the fibres or yarns together, which is stretchable or otherwise deformable in its own plane. Such textile may be supplied from a roll or the like in a length that is significantly greater than its width. Other substrates on which the invention may be performed may include paper or card based materials, film materials, foils, laminates such as wood-look melamine and any other material susceptible to transport in a continuous manner.

According to a yet further aspect of the present invention there is provided a device and method for calibrating a print head module having a plurality of overlapping heads. The device comprises a mounting jig for fixedly retaining the print head module, a viewing device for visually determining the relative positions of at least one reference marker on a first head and at least one reference marker on a second head; and an adjustment arrangement for moving the first head and second head relative to one another to achieve the desired overlap. Existing procedures for calibrating or setting up print heads into a print head module are generally performed in situ and can take considerable time. For a module having four offset heads it is estimated that up to eight hours calibration time would be required to calibrate the module on the machine. This time would be multiplied for each additional module mounted on a given carriage. Using the calibration device of the present invention such a print head module may be calibrated off-line in just one hour. Since calibration takes place off-line, interruption of the machine's operation is also reduced. Preferably the viewing device comprises a computer controlled non-contact measurement system operating in an X-Y field. An appropriate system is the QuickVision 404-Pro system available from Mitutoyo. Additional advantages according to the invention may be achieved by initial set-up of the printer in horizontal mode. Since the print head module of the invention is able to print at various swathe angles, it may also be operated without substrate movement to produce a horizontal swathe. The correct overlap and positioning of the individual nozzles may then be determined and individual modules may be mutually aligned within a carriage prior to commencing diagonal printing.

The invention also provides in general for an elongate compound print head for traversing across a continuously moving substrate to deposit a substance in a diagonal printing mode, comprising a plurality of separable print heads configured to deposit the substance in contiguous swathes to form a uniform compound swathe over a range of swathe angles with respect to a traverse axis of the compound print head. The individual heads may be as described above and may be mutually oriented in various different manners within the print module to achieve this objective as further described in exemplary form hereinafter.

BRIEF DESCRIPTION OF THE DRAWINGS

The features and advantages of the invention will be appreciated upon reference to the following drawings, in which.

DESCRIPTION OF ILLUSTRATIVE EMBODIMENTS

The following is a description of certain embodiments of the invention, given by way of example only and with reference to the drawings.

Figure 1:
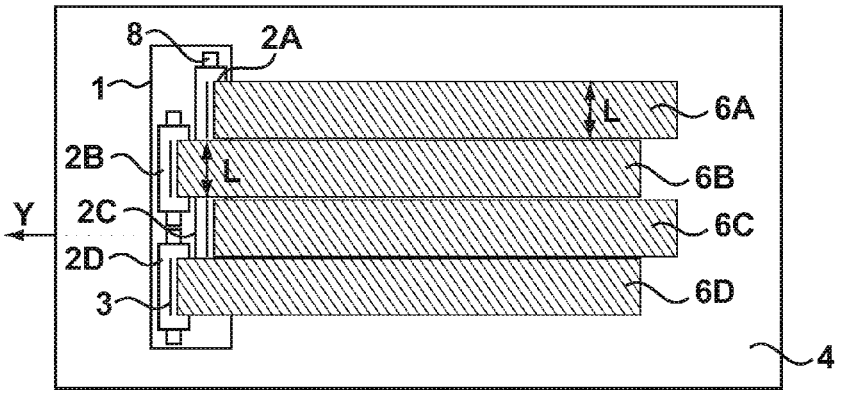
FIG. 1 is a schematic view of a conventional scan and step printing arrangement.

Referring to FIG. 1, a conventional print head module 1 is shown for printing broad swathes in a scan and step system. The module 1 comprises four heads 2A-D arranged in a staggered fashion in two parallel rows. Each head 2A-D has a plurality of dispensing nozzles 3 arranged in a line. The module 1 may be mounted to a carriage (not shown) for movement in a direction Y across a substrate 4 to deposit four swathes 6A-D. The spacing L between heads 2A and 2C corresponds to the length of head 2B such that swathe 6B precisely spans the gap between the swathes 6A and 6C. It is noted that L represents the active length of the head 2B over which the nozzles 3 are distributed. The physical head is actually longer than L due to the presence of fixation elements 8. In fact, it is the fixation elements 8 and the edge regions of the heads 2A-D that prevent the heads from being abutted directly to one another in a single row.

Figure 2:
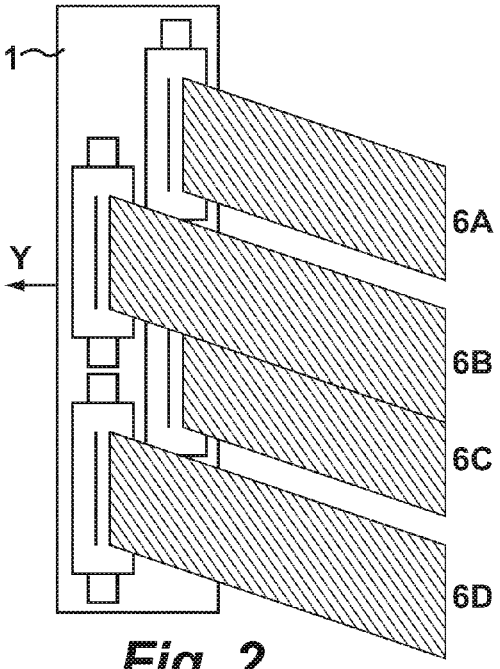
FIG. 2 is a schematic view of a conventional print module operating in diagonal mode.

Such an arrangement may work in a satisfactory manner when driven in scan and step mode to deposit a horizontal swathe. Nevertheless, according to FIG. 2 it may be noted that if used in diagonal mode, overlap regions occur between swathes 6B and 6C and gaps occur between swathes 6A and 6B. The reverse will occur when the module 1 makes a pass in the other direction. Such a head module is therefore generally unsuited for operation in diagonal mode printing.

Figure 3:
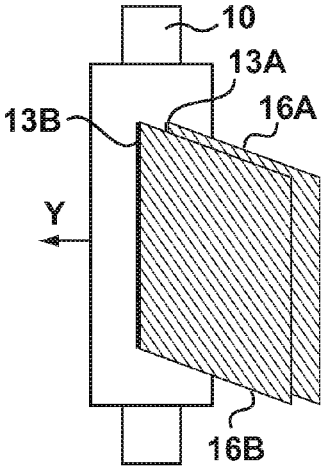
FIG. 3 is a schematic view of a conventional twin row print head operating in diagonal mode.

FIG. 3 shows a schematic close up of a conventional print head 10 having nozzles arranged in first and second parallel rows 13A, 13B. Such print heads are commonly used to provide increased traverse speed while retaining definition in the Y direction. The droplets from one of the rows are interlaced between those of the other row to achieve the required definition. As can be seen from the figure, the swathes 16A, 16B produced from the respective rows of nozzles 13A, 13B become offset as a result of operation in diagonal mode.

Figure 4:
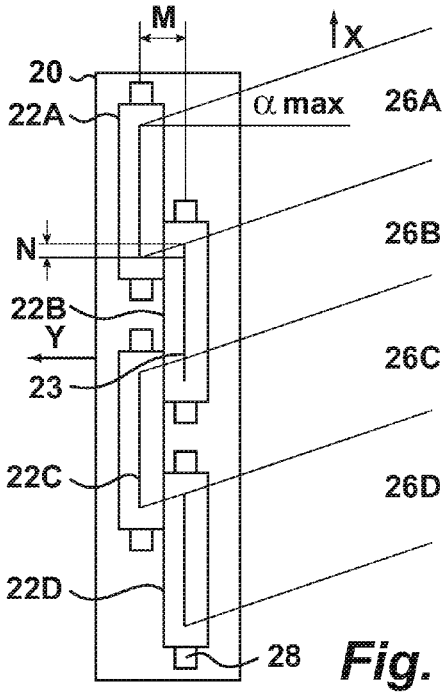
FIG. 4 is a schematic view of a print head module according to the present invention.

FIG. 4 depicts a print head module 20 according to the present invention. As in the prior art arrangement of FIG. 1, the module 20 includes four print heads 22A-D arranged in staggered fashion in two rows. The rows are spaced from one another by a distance M. In this case however, the heads 22A-D partially overlap one another in the X direction by a distance N. The module 20 is being driven diagonally at the maximum swathe angle $\alpha_{max}$ which corresponds to an angle of arctan N/M. At this angle, the top edge of swathe 26B aligns with the lower edge of swathe 22A. The lower edge of swathe 26B would overlap with the upper edge of swathe 26C. In order to avoid such overlap, a number of nozzles 23 in the overlap region are switched off. In the embodiment depicted in FIG. 4, a lowermost group of nozzles 23 from head 22B are switched off. The skilled person will understand that the same effect may be achieved by switching off the uppermost nozzles 23 from head 22C or by switching off some nozzles from both heads 22B and 22C.

Figure 5:
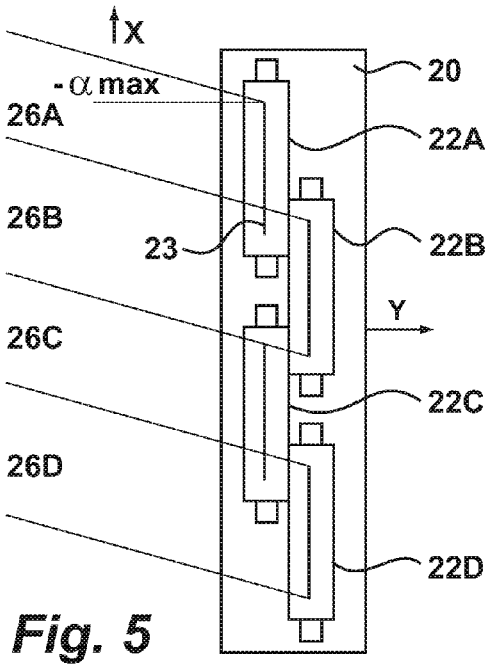
FIG. 5 is a schematic view of the print head module of FIG. 4 performing a reverse pass.

FIG. 5 depicts the print head module 20 during a traverse in the opposite direction to deposit another swathe at the maximum swathe angle $-\alpha_{max}$. As can be seen, in this direction, swathes 26A and 26B potentially overlap and this is avoided by switching off the lowermost nozzles 23 of head 22A.

Figure 6:
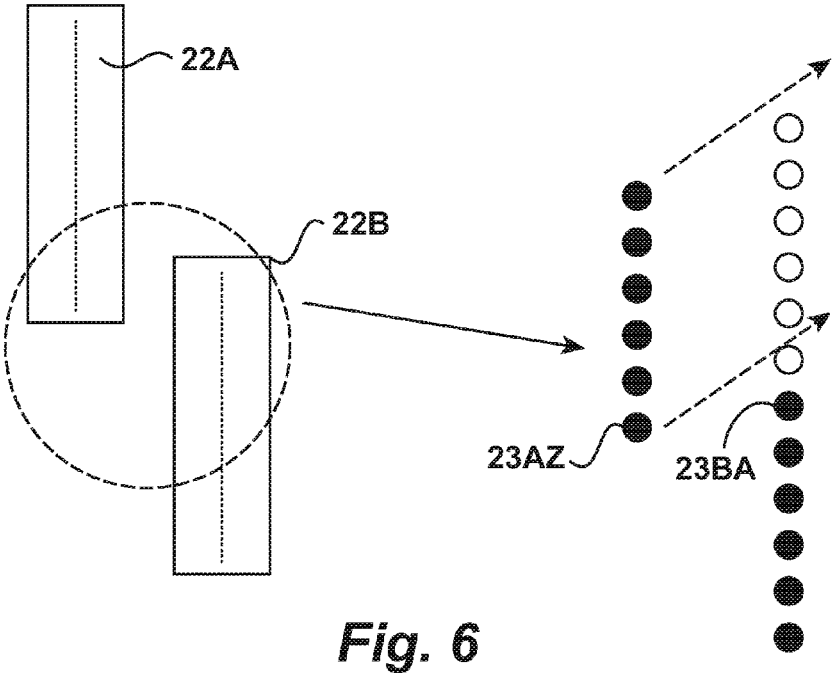
FIGS. 6 and 7 show the manner in which individual nozzles are switched off between forward and reverse passes.
Figure 7:
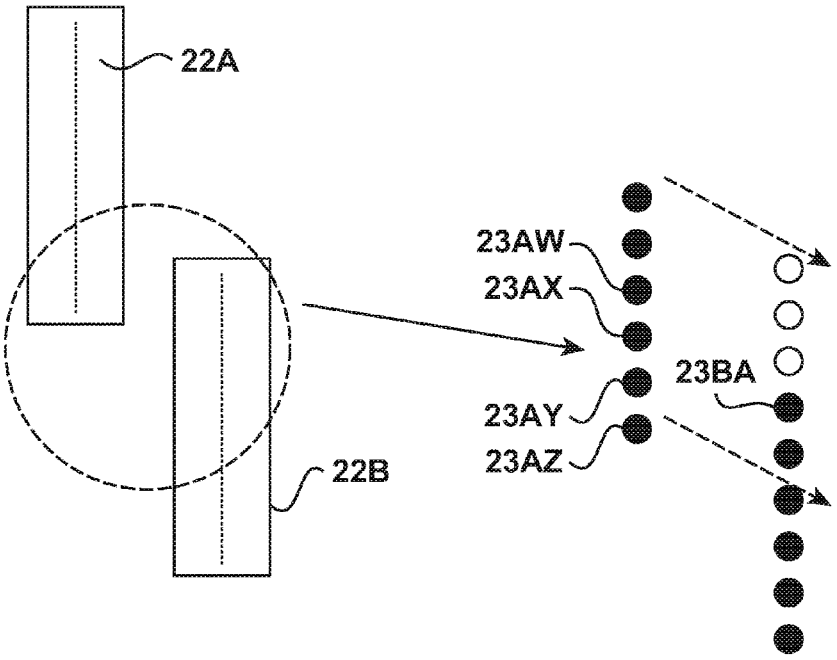

FIGS. 6 and 7 show in schematic detail the manner in which the individual nozzles are activated and deactivated for forward and reverse passes. Forward pass depicted in FIG. 6 corresponds to FIG. 4. The last nozzle 23AZ of head 22A passes a position vertically adjacent to a droplet deposited previously by the first nozzle 23BA of head 22B. In FIG. 7, printing takes place on the opposite diagonal. In order to avoid overlap, the last nozzles 23AZ, 23AY and 23AX are switched off. In this case, nozzle 23AW will print vertically adjacent to nozzle 23BA of head 22B. It may be noted in this depiction that for the sake of comparison, movement of the heads takes place in the same Y direction for both diagonals.

The skilled person in the field of inkjet deposition will understand that further technical aspects may need to be taken into consideration in order to implement the invention with particular heads. An example of one particular head is given in FIG. 8, which shows in perspective view a preferred head 22 for implementation of the invention. The head is a Xaar 1001™, which has two parallel rows each having 500 nozzles 23, spaced at 360 dpi over an active length of 70.5 mm. The two rows are spaced from one another by a distance of about 4.8 mm. The head is received in an opening 25 in the print head module 20 and held in position by fixation elements 28 located in an inactive region of the print head. When operating in diagonal mode with double row print heads of this type, shadowing may occur as described in relation to FIG. 3. In order to avoid this, certain nozzles may be switched off on each pass in order that both rows of nozzles stitch to substantially the same diagonal line. It has also been found desirable that such heads are driven at specific angles at which the droplets from each nozzle row interlace correctly.

Figure 8:
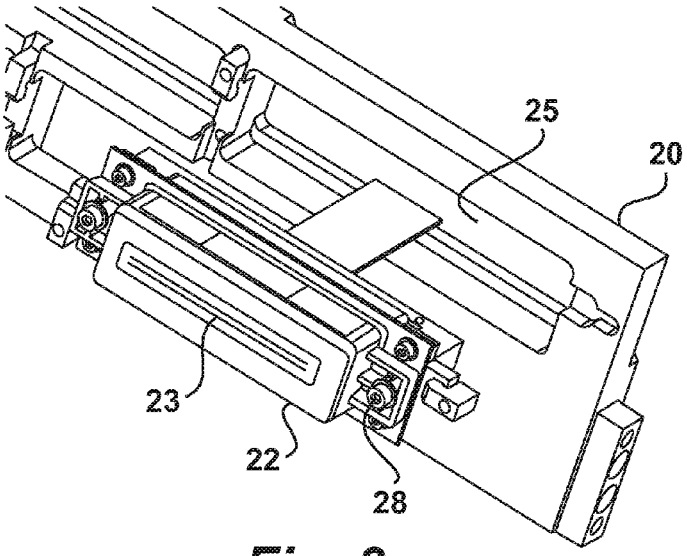
FIG. 8 shows in perspective view part of a print head module and a print head according to a preferred embodiment of the invention.
Figure 9:
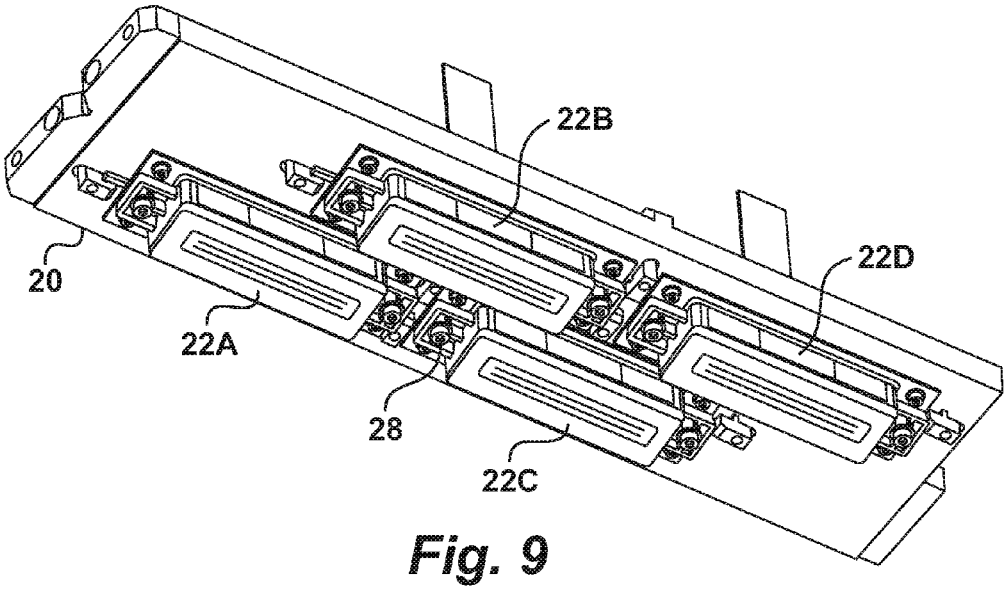
FIG. 9 shows the print head module according to FIG. 8 from below.
Figure 10:
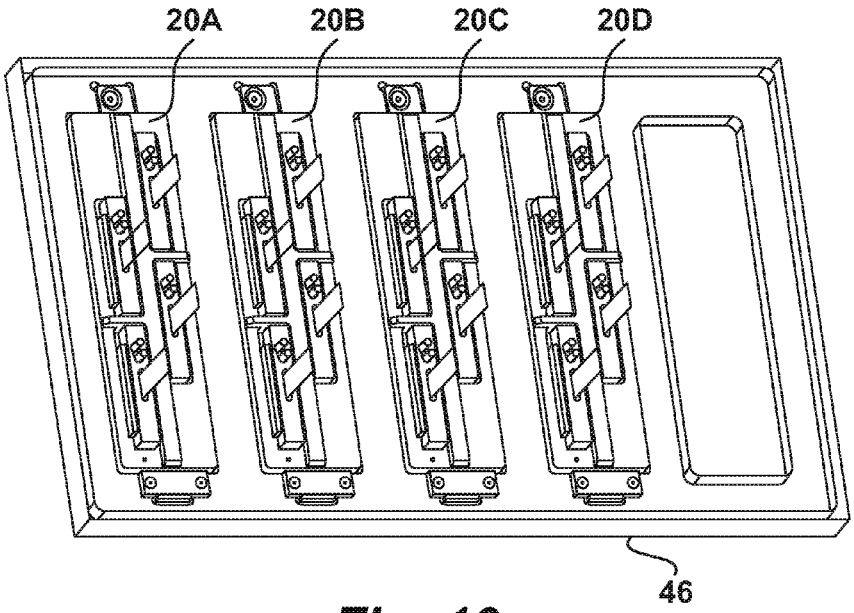
FIG. 10 shows in perspective view four print head modules according to FIG. 9 mounted in a printing carriage.

FIG. 9 depicts the complete print head module 20 of FIG. 8 in perspective view from below. The module is provided with four print heads 22A to 22D in staggered relation corresponding to FIGS. 4 and 5. The offset between the heads in the Y-direction is 40.8 mm and the overlap is around 3.5 mm for printing at a swathe angle of 5 degrees. FIG. 10 depicts part of a print carriage 46. Print carriage 46 receives four print head modules 20A to 20D of the type shown in FIG. 9. The print head modules 20A to 20D are mounted in a CMYK configuration whereby each of the modules prints an individual colour. An ink header tank (not shown) for each colour is mounted on the carriage 46 above each respective print head module 20A to 20D and is connected to supply ink in recirculating mode to the individual print heads 22.

Figure 11:
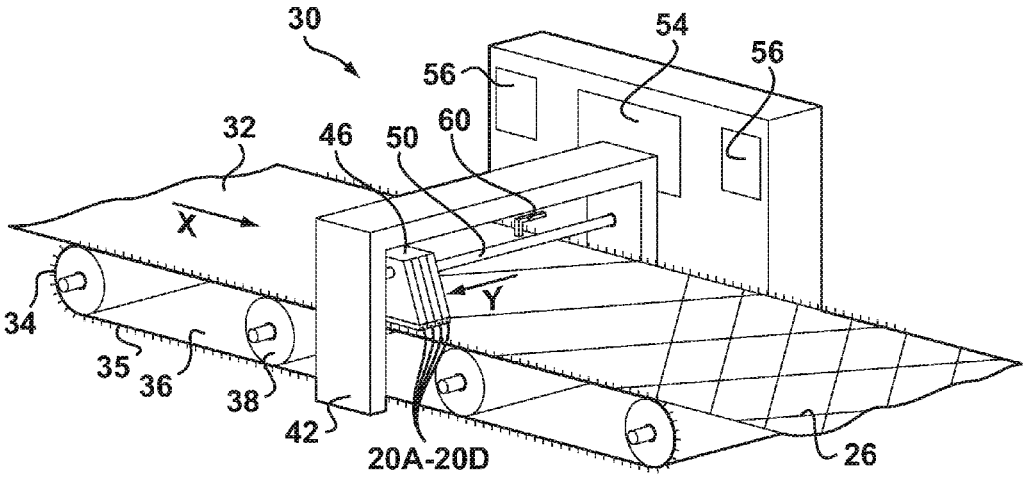
FIG. 11 shows a printer according to the invention.

FIG. 11 shows a perspective overview of a printer 30 for printing a textile substrate 32 according to the present invention. According to FIG. 11, the substrate 32 is supplied from a continuous supply such as a roll or J-frame or the like (not shown) and has a width of 1.6 m. A transport arrangement 34 in the form of a conveyor band 36 driven around a number of roller elements 38 carries the substrate 32 in a continuous manner in direction X at a maximum operational speed of about 20 m/min. In order to avoid relative movement between the band 36 and substrate 32, stenter pins 35 are carried by the band 36 to retain the substrate 32. The skilled person will be aware that other appropriate attachment arrangements may be provided if desired, to temporarily retain the substrate, including adhesive, vacuum, hooks and the like.

Printer 30 comprises a beam 42 spanning the substrate 32. A carriage 46 is arranged for reciprocal movement along a traverse mechanism 50 across the beam 42 in a direction Y. Movement of the carriage 46 is by appropriate motors (not shown) as generally used for printing carriages of this format. Carriage 46 carries a plurality of inkjet head modules 20A to 20D. Each module 20A-20D is provided with four Xaar 1001™ drop on demand inkjet heads having a resolution of 360 dpi and capable of producing variable drop volumes from 8 to 40 pl using grey-scale control. The modules 20 and their heads are removably arranged on the carriage 46 substantially as disclosed in FIGS. 9 and 10. The carriage 46 has a total overall length in the X direction of about 0.35 m. The skilled person will understand that other alternative arrangements of the print modules are possible e.g. according to the intended operation.

Figure 12:
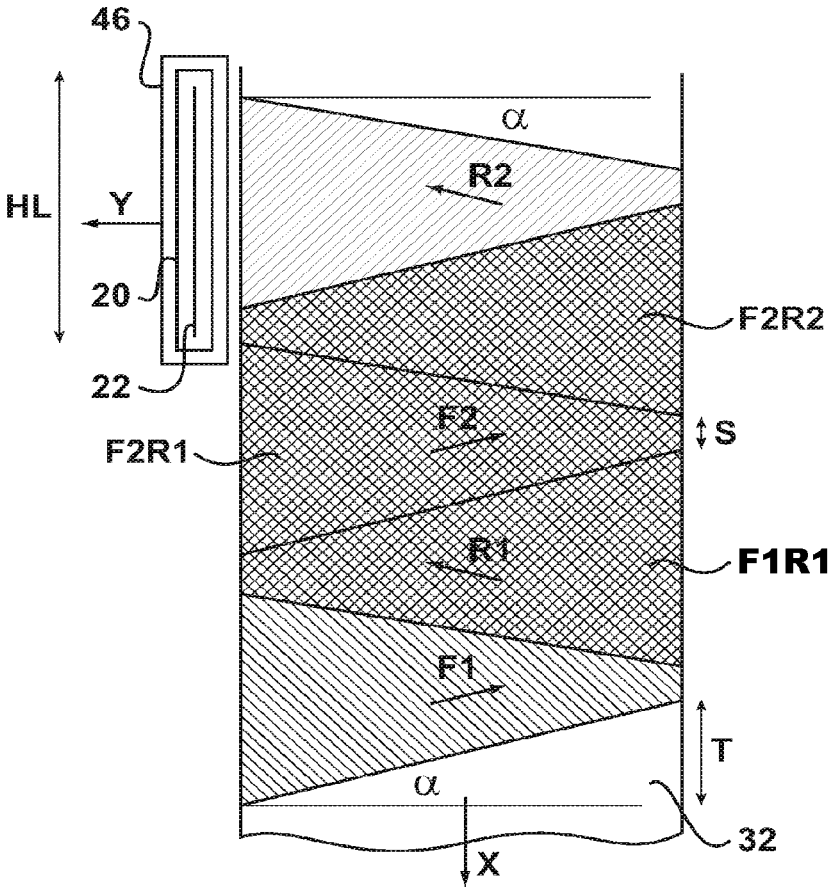
FIG. 12 shows part of a substrate during printing according to the invention.

Printer 30 additionally comprises a controller 54 and ink supplies 56 for supplying the ink header tanks on the carriage 46. The ink supplies 56 comprise individual reservoirs and pumps (not shown) for each of the inks. In the present context, although reference is made to ink, it is understood that this term applies to any substance intended for deposition onto the substrate and that inkjet head is intended to refer to any device suitable for applying that substance in a drop-wise manner. Above the substrate 32, adjacent to beam 42 is located an optical encoder 60, the function of which will be described below. FIG. 11 also shows swathes deposited on the substrate 32. Operation of a printer 30 of the type depicted in FIG. 11, will be described with reference to FIG. 12, which shows a substrate 32 and carriage 46. For the sake of the present description, the carriage is considered to operate with only a single print head module 20, although it will be understood that the principle applies equally if more print head modules operate. Furthermore, the print head module 20 is depicted as having a single compound head 22 which, as described in relation to FIGS. 4 and 5 above, produces a single compound swathe from the four individual swathes of the individual heads.

As can be seen, carriage 46 traverses in direction Y across the substrate 32 depositing a reverse pass R2 of a swathe as substrate moves in direction X. As a result, R2 is generally diagonal having a swathe angle $\alpha$ determined by the relative speeds of transport and traverse motion. The movement is represented as a diagonal movement of the carriage 46 although it will be understood that it is the substrate 32 that moves in the X direction. In previous traverses of the substrate 32, the carriage 36 has deposited forward and reverse passes F1, R1 and F2. The forward and reverse passes have overlapped in the regions marked F1R1, F2R1 and F2R2. In these regions full coverage has been achieved by ensuring that each portion of the substrate 22 is addressed on both a forward and a reverse pass. In order to avoid that areas remain uncovered, the swathe angle $\alpha$ is such that after two full traverses, the carriage begins a next pass precisely one swathe width beyond the previous traverse.

It may also be noted that after each traverse, there is a turnaround time in which the substrate travels a distance S. During the turnaround time, maintenance may be carried out on the heads. During the traverse of the carriage 36, the substrate advances a transport distance T. As can be seen from FIG. 12, S+T must be equal to half of the head length HL. This does not correspond directly to the swathe SL width due to the factor of the swathe angle $\alpha$.

Figure 13:
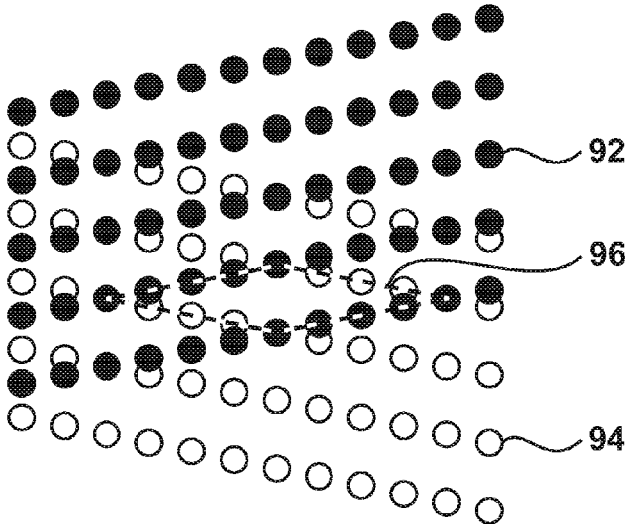
FIG. 13 depicts one possible deposition pattern produced according to the invention.

The skilled person will be aware that various alternative resolutions and matrix arrangements may be deposited according to the principles of the present invention. As an example of one possible deposition pattern, FIG. 13 depicts droplet locations deposited on forward and reverse passes across a substrate. The solid droplets 92 are deposited on a forward pass, while the outline droplets 94 are deposited on a reverse pass at a swathe angle of around 4 degrees. The droplets form a repeating pattern or cell 96 in the form of a rhombus having sides formed by five droplets. For each cell, ten droplets are deposited by each swathe.

Figure 14:
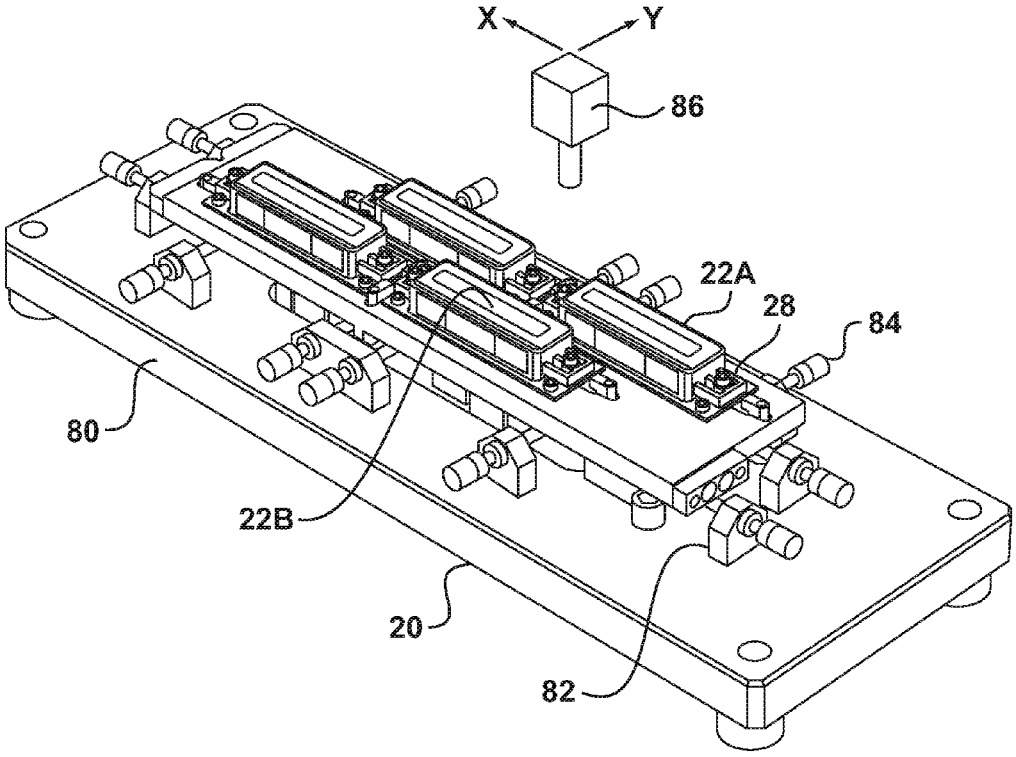
FIG. 14 shows a mounting jig according to a further aspect of the invention.

FIG. 14 shows another important aspect of the invention, namely a mounting jig 80 for assembling and adjusting a head module 20. The mounting jig 80 includes fixation elements 82 for locating the head module at a defined position. It further includes micrometer adjustment elements 84 for moving the first head 22A and second head 22B relative to one another to achieve a desired overlap between the respective nozzles. A viewing device 86 is moveably supported above the mounting jig 80 for calibrated movement in an X-Y plane. The viewing device allows visual determination of the relative positions of at least one reference marker on a first head and at least one reference marker on a second head. In general such reference markers are provided by the respective nozzles of the head. The micrometer adjustment elements 84 allow adjustment within the X-Y plane of the print head module 20. Thereafter the heads 22 can be locked in place using their fixation elements 28. Use of the mounting jig 80 allows a print head module 20 to be set up off-line in a minimal amount of time. Thus, the invention has been described by reference to certain embodiments discussed above. It will be recognized that these embodiments are susceptible to various modifications and alternative forms without departing from the spirit and scope of the invention. Accordingly, although specific embodiments have been described, these are examples only and are not limiting upon the scope of the invention.

What is claimed is:

1. A printer, comprising:

a substrate transport device for continuously transporting a supply of substrate in a transport direction;

a print carriage comprising at least one print head module for depositing a substance onto a substrate, the print head module having a transport axis and a traverse axis and comprising first and second print heads having nozzles for depositing the substance, the first and second print heads being staggered with respect to one another along the transport axis and offset from one another along the traverse axis to form an elongate compound head having a length greater than a length of either the first or the second print head, whereby the first and second print heads overlap one another along the transport axis by at least 45 nozzles, providing nozzle redundancy of more than 2.5% but less than 50% and allowing deposition onto the substrate at different swathe angles with respect to the traverse axis, of contiguous first and second swathes of the substance, from the nozzles of the respective first and second print heads, the print carriage having a transport axis generally aligned with the transport direction and arranged to traverse across the substrate for deposition of the substance in opposite diagonal swathes; and a controller arranged to deactivate a first group of nozzles during a first traverse and deactivate a second group of nozzles on a second traverse during deposition of the substance in opposite diagonal swaths.

2. The printer according to claim 1, wherein the first and second print heads are arranged in at least first and second parallel rows with their nozzles aligned substantially parallel to the transport axis.

3. The printer according to claim 2, wherein each row comprises a plurality of print heads, arranged in comb formation with a gap between adjacent heads being smaller than the length of a head.

4. The printer according to claim 2, wherein each print head has a width and the rows are offset from one another by about said width.

5. The print head module according to claim 4, wherein the width is from about 0.5 cm to about 4 cm.

6. The printer according to claim 1, wherein the print heads overlap with a nozzle redundancy of more than 5%.

7. The printer according to claim 1, wherein the print heads overlap sufficiently to permit printing of swathes over swathe angles of at least +3° with respect to the traverse axis.

8. The printer according to claim 1, comprising at least four print heads.

9. The printer according to claim 1, wherein the print heads are of the drop on demand type.

10. The printer according to claim 1, wherein the print heads provide grey-scale droplet deposition.

11. The printer according to claim 1, further comprising a control arrangement for synchronising a traverse speed or position of the print carriage to a transport speed or position of the substrate such that the opposite diagonal swathes are complementary to each another and each region of the substrate is addressed by both diagonal swathes.

12. The printer according to claim 1, wherein the substrate comprises a textile and the transport device comprises an attachment arrangement to prevent shifting of the substrate with respect to the transport device during deposition.

13. A method of depositing a substance onto a continuously moving substrate in forward and reverse transverse passes, the method comprising:

providing a print head module comprising a plurality of print heads provided with nozzles, whereby at least certain nozzles are redundant for a given transverse pass;

traversing the print head module across the substrate in a forward pass, during which a first plurality of nozzles is switched off to deposit the substance in a first uniform diagonal compound swathe;

subsequently traversing the print head module across the substrate in a reverse pass, during which a second plurality of nozzles is switched off to deposit the substance in a second uniform diagonal compound swathe.

14. The method according to claim 13, wherein the heads are arranged in at least first and second parallel rows with their nozzles substantially aligned with the transport direction.

15. The method according to claim 13, wherein the heads overlap with a nozzle redundancy such that during each traverse between 2.5% and 50% of the nozzles are switched off to achieve the uniform diagonal compound swathes.

16. The method according to claim 13, comprising synchronising a traverse speed or position of the print head module to a transport speed or position of the substrate to produce diagonal swathes over swathe angles of at least 3° with respect to a traverse direction.

17. The method according to claim 13, wherein the heads overlap one another by more than 5 nozzles.

18. The method according to claim 13, wherein the print head module comprises at least four heads depositing the same substance.

19. The method according to claim 13, wherein the nozzles are individually controlled to deposit a drop on demand.

20. The method according to claim 13, further comprising performing maintenance on the heads between the forward and reverse passes.

21. The method according to claim 13, further comprising synchronising a traverse speed or position of the print carriage to a transport speed or position of the substrate to ensure alignment of a first compound swathe deposited on a first forward pass with a subsequent compound swathe on a subsequent forward pass.

22. The method according to claim 13, further comprising controlling the swathe angle and the operation of the nozzles to deposit individual droplets of the substance on the substrate at defined matrix locations based on a spacing between adjacent nozzles.

23. The method according to claim 13, further comprising controlling the swathe angle and the operation of the nozzles to deposit individual droplets of the substance on the substrate whereby each region of the substrate is addressed both by the first compound swathe and by the second compound swathe.

24. The method according to claim 13, further comprising controlling edge regions of respective swathes using stitching software to reduce alignment perturbations between passes.

25. The method according to claim 13, wherein the heads are of the grey-scale drop-on-demand type and the method further comprises adjusting the volume of substance deposited by each drop.

26. The method according to claim 13, comprising driving the inkjet heads using a dither function to provide accurate colour or shade reproduction.

27. The method according to claim 13, wherein the substrate is a textile and the substance is a finishing composition for application to the textile.

28. The method according to claim 27, wherein the finishing composition is selected from the group consisting of anti-static, anti-microbial, anti-viral, anti-fungal, medicinal, non-crease, flame-retardant, water-repellent, UV-protective, anti-odour, wear-resistant, stain-resistant, self-cleaning, adhesive, stiffening, softening, elasticity-enhancing, pigment-binding, conducting, semi-conducting, photo-sensitive, photo-voltaic, light-emitting, optical brightening, shrink resistant, handle imparting, filling & stiffening, weighting, softening, oil-repellent, soil repellent, soil release, felting, anti-felting, conditioning, lustring, delustring, non-slip, moisture vapour transport, anti-snagging, anti-microbiotic, reflecting, controlled release, indicating, phase changing, hydrophilic, hydrophobic, sensory, abrasion resistant and wetting agents.

29. The method according to claim 13, wherein the substrate is a textile and the substance is an ink or dye and the method comprises uniform application of the ink or dye over substantially the whole surface of the textile.

30. The method according to claim 13, wherein the substance is an ink or dye and the method comprises printing of an image or text onto the substrate.

31. A printer, comprising:

a substrate transport device for continuously transporting a supply of substrate in a transport direction;

an elongate compound print head for traversing across the continuously moving substrate to deposit a substance in a diagonal printing mode, comprising a plurality of separable print heads; and a controller arranged to deactivate a first group of nozzles during a first traverse and deactivate a second group of nozzles on a second traverse to deposit the substance in the diagonal printing mode in contiguous swathes to form a uniform compound swathe over swathe angles of at least 3° with respect to a traverse axis of the compound print head.

* * * * *